US007165367B2

(12) United States Patent
Habicht

(10) Patent No.: US 7,165,367 B2
(45) Date of Patent: Jan. 23, 2007

(54) COMPOSITE PROFILE AND METHOD FOR PRODUCING A COMPOSITE PROFILE

(75) Inventor: Siegfried Habicht, Leopoldshöhe (DE)

(73) Assignee: Schüco International KG, Bielefeld (DE)

( * ) Notice: Subject to any disclaimer, the term of this patent is extended or adjusted under 35 U.S.C. 154(b) by 355 days.

(21) Appl. No.: 10/256,385

(22) Filed: Sep. 27, 2002

(65) Prior Publication Data

US 2003/0019184 A1 Jan. 30, 2003

Related U.S. Application Data

(63) Continuation of application No. PCT/EP01/03396, filed on Mar. 26, 2001.

(30) Foreign Application Priority Data

Mar. 31, 2000 (DE) ..... 100 15 986

(51) Int. Cl.
*E04B 1/74* (2006.01)

(52) U.S. Cl. ..... 52/407.1; 52/281; 52/407.3; 52/656.9; 52/774; 52/775; 52/741.3; 52/741.4

(58) Field of Classification Search ..... 52/404.1, 52/404.4, 404.5, 407.1, 407.3, 281, 656.9, 52/773–775, 741.3, 741.4
See application file for complete search history.

(56) References Cited

U.S. PATENT DOCUMENTS

| | | | | |
|---|---|---|---|---|
| 3,393,487 | A | 7/1968 | Nolan | |
| 3,517,472 | A * | 6/1970 | Toth | 52/204.591 |
| 3,925,953 | A * | 12/1975 | LaBorde | 52/745.19 |
| 4,069,631 | A * | 1/1978 | Nahr | 52/309.5 |
| 4,158,512 | A * | 6/1979 | Hasselbacher | 403/294 |
| 4,164,830 | A * | 8/1979 | Bierlich | 52/204.593 |
| 4,333,295 | A * | 6/1982 | Janke | 52/730.1 |
| 4,461,133 | A * | 7/1984 | Laroche | 52/730.3 |
| 4,524,112 | A * | 6/1985 | Willert | 428/595 |
| 4,614,062 | A * | 9/1986 | Sperr | 49/504 |
| 4,642,870 | A * | 2/1987 | Schulz | 29/509 |
| 4,704,839 | A * | 11/1987 | Kay | 52/717.02 |
| 5,117,601 | A * | 6/1992 | Habicht | 52/281 |
| 5,469,683 | A * | 11/1995 | McKenna et al. | 52/730.3 |
| 6,035,596 | A * | 3/2000 | Brunnhofer | 52/404.1 |
| 6,202,353 | B1 * | 3/2001 | Giacomelli | 49/504 |
| 6,397,551 | B1 * | 6/2002 | Lewcock et al. | 52/655.1 |
| 6,668,500 | B1 * | 12/2003 | Lamberts | 52/204.72 |

FOREIGN PATENT DOCUMENTS

| | | |
|---|---|---|
| DE | 21 30 496 | 12/1972 |
| DE | G 75 07 260 | 1/1976 |
| DE | 28 21 096 | 11/1979 |
| DE | 25 52 700 | 6/1980 |
| DE | 29 08 950 | 9/1980 |

(Continued)

*Primary Examiner*—Naoko Slack
*Assistant Examiner*—Yvonne M. Horton
(74) *Attorney, Agent, or Firm*—Henry M. Feiereisen

(57) ABSTRACT

The invention relates to a composite profile and to a method for the producing a composite profile. The profile is configured as an assembly with at least one metal profile and at least one insulating profile, wherein a tolerance-compensating gap is located between a metal profile and an insulating profile.

33 Claims, 8 Drawing Sheets

FOREIGN PATENT DOCUMENTS

| | | |
|---|---|---|
| DE | 26 60 436 | 5/1981 |
| DE | G 78 21 041 | 5/1982 |
| DE | 33 19 262 | 5/1984 |
| DE | 32 29 230 | 6/1984 |
| DE | 32 45 078 | 6/1984 |
| DE | 30 33 206 | 7/1984 |
| DE | 33 42 700 | 1/1985 |
| DE | 30 35 526 | 4/1985 |
| DE | 34 40 710 | 5/1986 |
| DE | 28 26 874 | 7/1986 |
| DE | 35 14 538 | 8/1986 |
| DE | 36 03 507 | 8/1987 |
| DE | 33 30 391 | 7/1990 |
| DE | 33 00 599 | 8/1994 |
| DE | 196 43 681 | 4/1998 |
| EP | 0 103 272 | 3/1984 |
| GB | 2 058 893 | 4/1981 |
| GB | 2 083 116 | 3/1982 |

* cited by examiner

COMPOSITE PROFILE AND METHOD FOR PRODUCING A COMPOSITE PROFILE

CROSS-REFERENCES TO RELATED APPLICATIONS

This application is a continuation of prior filed copending PCT International application no. PCT/EP01/03396, filed Mar. 26, 2001, which was not published in English and which designated the United States and on which priority is claimed under 35 U.S.C. §120, the disclosure of which is hereby incorporated by reference.

This application claims the priority of German Patent Application Serial No. 100 15 986.9, filed Mar. 31, 2000, pursuant to 35 U.S.C. 119(a)–(d), the disclosure of which is incorporated herein by reference.

BACKGROUND OF THE INVENTION

The present invention relates to a composite profile, in particular a heat-insulating composite profile, for windows, doors, facades or skylights. The invention also relates to a method for producing such a composite profile.

Prior art profiles, such as the profile disclosed in DE 25 52 700 and shown in FIG. 1, consist of a first and a second metal profile and two mutually parallel insulating profiles which connect the metal profiles with each other. The insulating projections are preventing from coming out of the receiving grooves by base sections which are disposed in the insulating profiles and engage with the receiving grooves of the metal profiles, as well as a tight press fit of the insulating projections in the receiving grooves. The press fit is implemented by forming or pressing the outer or inner projections onto the insulating projections at the time the insulating sections are inserted into the receiving grooves.

The composite profile is produced by first orienting the metal profiles relative to each other so that the receiving grooves for the insulating profile face each other. The insulating profiles are then pushed or inserted into the receiving grooves and later aligned with each other in a mounting device and tensioned, with the tensioning forces applied to the outside surfaces. The composite is fixed by plastically forming projections on the insulating profile.

The projections can be formed in the mounting device by either moving the profile past the device or by guiding the device across the stationary profile for forming the projections.

The construction depth of the composite profile of this type is calculated by adding the construction depths of the sequentially arranged individual elements, first metal profile, insulating profile and second metal profile. Conventional profiles have therefore a construction depth with a manufacturing tolerance which is the sum of the manufacturing tolerances of the individual elements. Details of the tolerance budget of the profile of FIG. 1 are given below.

The tolerances of the metal and plastic profiles cannot be reduced below certain minimum tolerances governed by manufacturing conditions—typically, relatively complex technical processes, such as extrusion molding of the metal profiles and extrusion of the plastic profiles (insulating profile), are selected—, which already causes a significant increase in the manufacturing cost of the profiles. Accordingly, relatively large variations results when the tolerances of the individual components are added which in practice can amount to a total tolerance g=±0.7 mm. The alignment tolerances mentioned above have also to be added; these are, however, typically rather small and may even approach zero.

The heat-insulating composite profiles for windows, doors and facades are assembled into frames or crossbar/post constructions, wherein the profiles are mitered or butt-joined. The large tolerances of the various assembled profiles cause different problems. For example, large tolerances can result in an irregular visual appearance. The tolerances can also produce sharp edges where the profiles intersect, which can cause injury during operation or cleaning. In addition to these effects, the tolerances also create technical problems when the profiles are joined or mechanically finished, for example, during sawing or milling for installing fittings and accessories, and lead to poor functionality of the completed elements (for example, leaks, binding, etc.).

It would therefore be desirable and advantageous to obviate prior art shortcomings and to reduce the total tolerance of the composite profile and to relax limitations in the tolerances of the individual profiles.

SUMMARY OF THE INVENTION

The invention is directed to a composite profile, in particular a heat-insulating composite profile for windows, doors, facades and skylights, wherein a gap is formed between the groove bottom of the at least one receiving groove for an insulating profile and the least one plastic and/or insulating profile.

According to one aspect of the invention, a composite profile includes at least one metal profile with an outer side and at least one receiving groove disposed opposite the outer side and having a groove bottom and projections oriented at an angle to the groove bottom, and at least one insulating profile having a base section received in the at least one receiving groove and a second opposing section, with a gap being formed between the groove bottom and the base section of the at least one insulating profile. The outer side of the at least one metal profile and the second section the at least one insulating profile or the other side of a second of the at least one metal profiles are spaced apart from each other by a predetermined distance, wherein the at least one metal profile is fixed in position relative to the insulating profile by a press fit between the projections and the at least one insulating profile.

According to another aspect of the invention, a method for producing a composite profile includes the steps of providing at least one metal profile having at least one receiving groove with a groove bottom and projections oriented at an angle to the groove bottom, and at least one insulating profile; inserting the at least one insulating profile into the receiving groove of the at least one metal profile; placing a resilient element between the at least one metal profile and the at least one insulating profile; aligning the at least one metal profile and the at least one insulating profile relative to each other in a mounting device so that opposing outer sides of the at least one metal profile and the at least one insulating profile are spaced apart from each other by a nominal distance, and urging the at least one metal profile against guide elements of the mounting device so as to press the projections against the at least one insulating profile and to thereby fix the position of the at least one metal profile relative to the at least one insulating profile.

In the process for producing the composite profile, the outer surfaces of the metal profile are hence maintained by the mounting device at the nominal distance G. The position assumed by the insulating profiles inside the receiving grooves is then fixed and frozen, for example simply by holding the projections in place by a press fit. In this way, the overall tolerance relative to the nominal distance G of the composite profile reaches a value which corresponds essentially to the tolerance of the mounting device, while the individual tolerances of the metal profiles and insulating profile need not be limited beyond the state of the art. Indeed, the tolerances can even be increased which simplifies the manufacturing process of the individual profiles and reduces the cost significantly.

Preferably, at least one spring elements and/or an elastically compressible element are arranged and/or formed between the at least one metal profile and the at least one insulating profile, with the element being formed preferably as a single piece with or separate from the at least one metal profile and the at least one insulating profile. According to one embodiment, the elastically compressible element can also be arranged in the at least one gap and can fill the gap either partially or completely. The dimensions of the spring element should be selected so that it urges the insulating profile and the metal profile apart so that the outer sides make contact with or abut the mounting device. Like the elastically compressible element, the spring element can also fill the gap either partially or completely.

The invention is suitable for any type of composite profile wherein at least one plastic profile and one metal profile—in particular made of light metal such as aluminum or an aluminum alloy, but also steel—can be joined to a composite profile.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
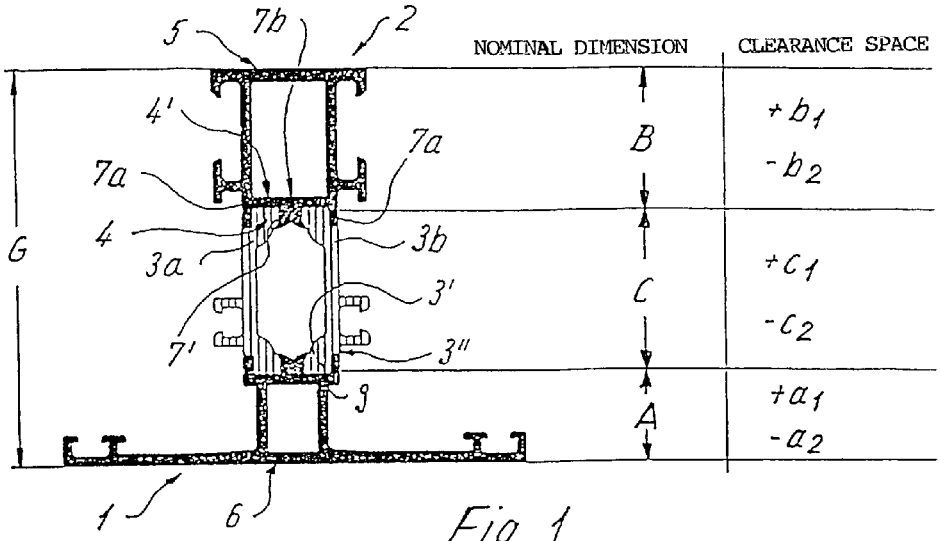
FIG. 1 shows a conventional heat-insulating composite profile.

Throughout all the Figures, same or corresponding elements are generally indicated by same reference numerals.

FIG. 1 shows a prior art heat-insulating composite profile which includes a first metal profile 1, a second metal profile 2 and two mutually parallel insulating profiles 3*a*, 3*b*. To achieve an insulating effect between the metal profiles 1, 2, at least one of the insulating profiles 3 should be provided. The insulating profiles 3 have an essentially oblong rail-like form and engage with their end sections 9—referred to as base section—in receiving grooves 4 for the insulating profiles (hereinafter referred to as receiving grooves 4). The receiving grooves have a groove bottom 4' and two outer projections 7*a* which are oriented perpendicular to the groove bottom 4' and parallel to the insulating profiles 3, as well as an inner projection 7*b* which is common to the two receiving grooves. The altogether three projections 7 are essentially oriented parallel to one another, whereby the sides of the center projection 7*b* that face the receiving grooves 4 form an undercut 7', in which a lateral projection 3' engages which is oriented at an angle to the principal direction of the insulating profile 3. The wall of the insulating profile is oriented essentially parallel to the insulating projection on the contact surface to the outer projections 7*a*, making direct contact therewith.

It should be noted that the base sections 9 are formed with an offset relative to the principal plane of the insulating profiles between the two metal profiles 1, 2 and are approximately parallel to the principal plane, thereby forming a shoulder 3" which is located essentially directly in the plane defined by the projection 7 of the receiving groove 4. Pressing forces in the direction of the plane of the insulating projections 3 are hence not directed away via the end face of the projections 7 and the insulating profile 3, but rather through their base sections 9.

The base sections 9 of the insulating sections thereby prevent the insulating projections 3 from coming out of the receiving grooves, with additional safety provided by a press fit of the insulating projection 3 in the receiving groove 4. The press fit is implemented by forming or pressing the outer projections 7 against the insulating projections when the insulating projections 3 are inserted in the receiving grooves 4. Alternatively (not shown), inner projections can be formed instead of the outer projections.

The insulating profile of FIG. 1 can be produced by the following process. First, the metal profiles 1, 2 are oriented relative to each other so that the receiving grooves 4 for the insulating profile face each other. The insulating profiles 3 are then pushed into or inserted in the receiving grooves. The metal profiles 1, 2 are then oriented relative to each other in a mounting device and tensioned, whereby the tensioning forces are applied to the outside surfaces 5, 6. Then the insulating profile is secured by forming the outer projections 7*a* plastically onto the insulating profile.

The projections 7 can be formed by a mounting device, whereby either the composite profile is moved through the device or the device is guided over the stationary profile for forming the projections 7.

The construction depth G is calculated as the sum of a sequentially arranged construction depths of the individual elements, first metal profile 1 (construction depth A), insulating profile 3 (construction depth C) and second metal profile 2 (construction depth B). It therefore holds $$G=A+B+C.$$

In this conventional device, the construction depth G of the profile is determined in that the base front edges of the insulating profiles 3 contact the groove bottom 4' of the receiving grooves 4. In this design, the practically unavoidable deviations of the individual profiles 1, 2, 3 from their nominal values together with the tolerance of the mounting device disadvantageously add up to a total tolerance, which can be written as:

$$g=a+b+c+vt,$$

wherein:

g:=total tolerance of the composite profile in the direction of the three sequentially arranged profiles 1, 2, 3;

a:=individual tolerance of the profile 1;

b:=individual tolerance of the profile 1;

c:=individual tolerance of the profile 1;

vt:=device tolerance of the mounting device.

This results in a conventional construction depth G in which the individual tolerances a, b, c, vt are added.

The device tolerance vt of the mounting device is relatively small compared to the individual tolerances of the insulating profiles 1, 2, 3. The following approximation therefore holds:

$$g \sim a+b+c.$$

The individual tolerances a, b, c are obtained by adding the maximum positive tolerances +a1, +b1, +c1 and the negative tolerances −a2, −b2, −c2. The same process applies to the total tolerance g.

The following relations hold for the maximum positive deviation +g1 and the maximum negative deviation −g2:

$$+g1=a1+b1+c1$$

$$-g2=-a2-b2-c2.$$

As mentioned before, the values of +g1 and −g2 can reach 0.7 mm.

Figure 2:
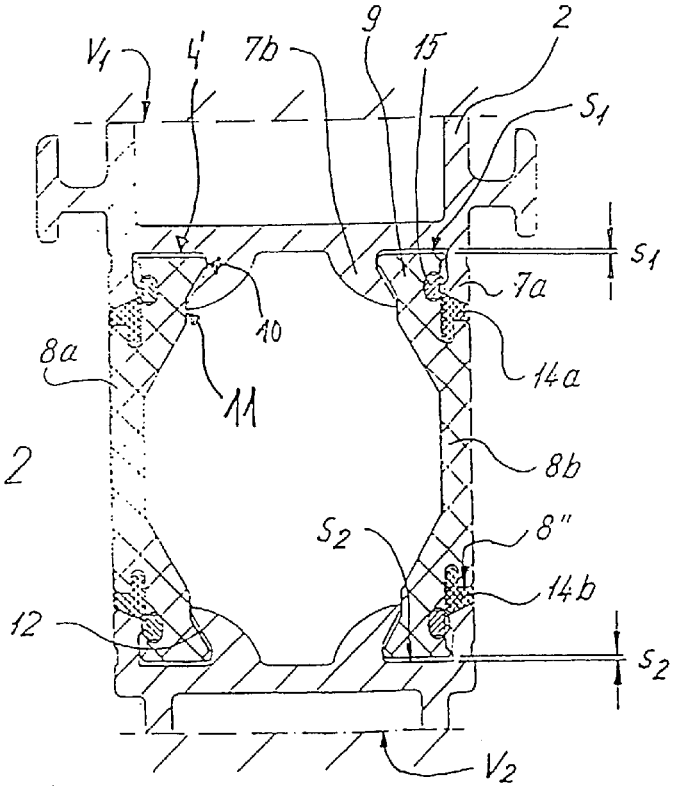
FIG. 2 is a heat-insulating composite profile according to an embodiment of the invention.

Referring now to FIG. 2, an exemplary heat-insulating composite profile according to the invention has a connecting region, wherein the individual construction depth A, B and G are matched to each other, leaving a corresponding gap S1, S2 with a dimension s1, s2 between each of the insulating profiles 8*a*, 8*b*. The total gap dimension s=s1+s2 of the gaps S1 and S2 is between 0 and the absolute value of the sum of the maximum negative individual tolerances −a2, −b2, −c2. The basic construction of the composite profile in the individual profiles 1, 2 and 8 has to be modified compared to conventional designs only in the region of the receiving grooves 4, preferably necessitating only in a modification of the insulating profiles 8.

The maximum gap width is reached when all individual components have the maximum negative tolerance, since the sum of the gap spacings s1+s2 of the gaps S1+S2 is the sum of all actually occurring positive and negative tolerances (sum of the clearance spaces).

In the event that the individual components are all located in the maximum positive tolerance region, the sum of the gap spacings s1+s2 of the gaps S1+S2 approaches zero. However, an additional (minimum) gap can be provided which can exist even if all positive tolerances have been exhausted.

As a result, a total construction depth is obtained which is independent of the individual tolerances and only influenced by the tolerances vt of the mounting device i.e., approaches zero when the mounting device tolerance is negligible.

It is a prerequisite for carrying out the method that the insulating profile 8, preferably the base section 9 of the insulating profile, is moveable in receiving groove 4 relative to the metal profiles 1, 2 in the direction of the construction depth G by a distance which corresponds to half the maximum negative tolerance −g2.

This means that the insulating profile base section 9 generally makes contact only with a surface 10, 20 and/or 11 which extends parallel to the X-plane of the undercut 7'. A corresponding gap 12 is provided in a region of the form-fitting undercut of the insulating profile base 9.

The assembly process for the composite profile will now be described.

In the method for producing the composite profile, the mutually parallel outer surfaces 5 and 6 of the profiles 1 and 2 have to be held at a nominal distance G by a mounting device. A mounting device where the profiles are stationary can employ tensioning devices. The position assumed by the insulating profile 8 within the receiving grooves 4 is then permanently fixed in position by forming the projections 7 by a press fit. In this way, the total tolerance G of the composite profile reaches a value which is essentially equal to the tolerance of the mounting device.

If a composite profile passes through a stationary mounting device, then the surfaces 5 and 6 of the metal profile shells 1 and 2 have to be pressed against the guide rollers and/or guide surfaces of the mounting device for forming the projections 7. This can be, for example, easily accomplished by guide rollers which engage with projections disposed on the outside, or by an elastic spring element 13 (see FIG. 3) which is inserted, for example, into the hollow chamber formed between the profile shells/metal profiles and the insulating projections/profiles. This spring element 13 operates in the plane indicated with the letter X and urges the two metal profiles or profile shells 1 and 2 apart against the limits V1, V2 of the mounting device.

In the two aforedescribed methods, the insulating profiles 8 assume an arbitrary position in the receiving groove 4 which can result in two different gap distances s1, s2 on the same insulating profile 8.

Two resilient elements 14*a*, 14*b* can be used to equalize the gap distances s1, s2 of the opposing gaps S1, S2 in an intermediate position between the metal profiles 1, 2, wherein the resilient elements 14*a*, 14*b* are arranged between the metal profile 1 and the insulating profile 8 and between the metal profile 2 and the insulating profile 8, respectively, in the present embodiment essentially between the front face of the projection 7 and the shoulder 8" of the insulating profile. The resilient elements 14 not only center the insulating profile relative to the two metal profiles 1, 2, but also urge the two metal profiles 1, 2 a part, so that these make contact with their outer surfaces or outer edges 5, 6 with the boundary of the mounting device. A separate spring element 13 or another means in the device for urging the two metal profiles apart is therefore no longer required. The resilient elements 14 on the insulating profile 8 therefore replace the function of a spring element 13 and/or special holding devices for the metal profiles 1 and 2 on the mounting device, which provides the particularly simple and advantageous solution of the invention.

Figure 3:
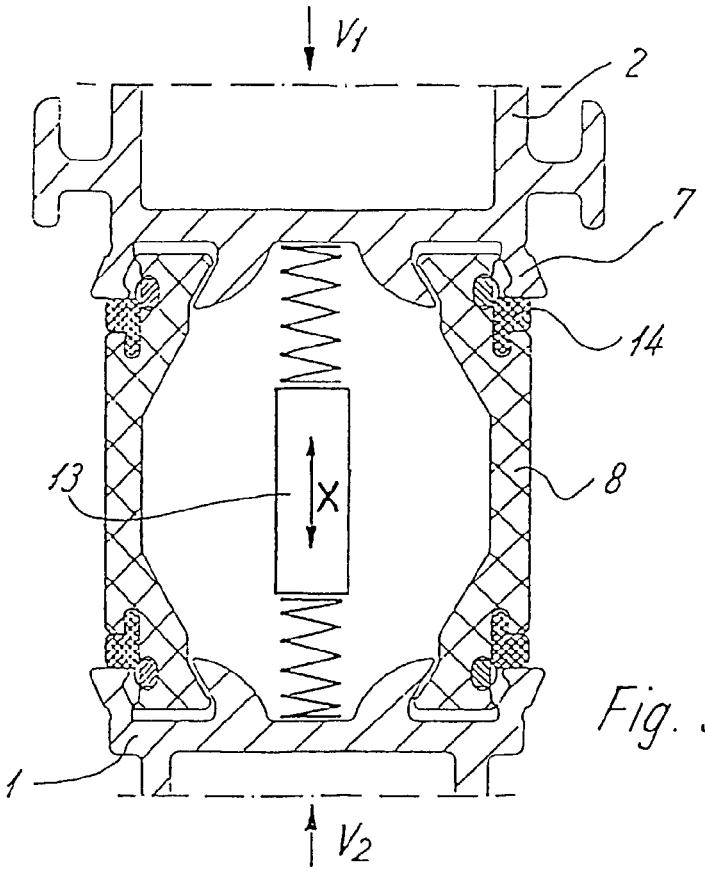
FIGS. 3–4 show a connecting region between a metal profile and an insulating profile in different states of assembly of the embodiment of FIG. 2.

FIG. 3 shows the composite profile before being joined. The projections 7 are not yet formed on the insulating profiles 8. The resilient elements 14 are relaxed in the direction of the X-axis of the profile and the thereby drive the metal profiles 1 and 2 apart beyond the nominal value G.

When passing through the mounting device, the resilient elements 14 are compressed, thereby exerting a restoring force on the metal profiles 1, 2 which ensures contact between the metal profiles 1 and 2 and the mounting device itself.

Figure 4:
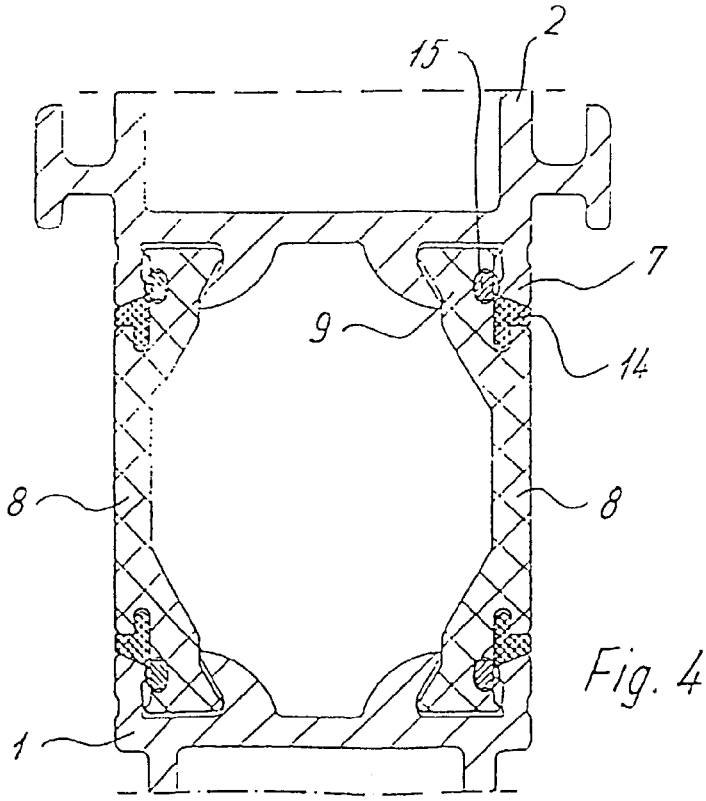

FIG. 4 corresponds to FIG. 2 in a position where the metal profiles 1 and 2 are completely secured and connected with the insulating profiles 8. The groove projections 7 are formed on the base section 9 of the insulating profiles, whereby an interlocked or knurled wire 15 is arranged between a lateral groove in the base section 9 of the insulating profile 8 for transmitting a transverse load. The wire 15 contacts with a portion of its outer circumference the inside of the projections 7*a* and establishes a form fit in the longitudinal direction of the profile. The resilient element 14 is dimensioned in the X-axis so as to exert a most uniform and constant spring force along the deformation path. In most practical applications, the thickness of the resilient elements 14 in the direction of the X-axis is at least 2 mm.

Figure 5:
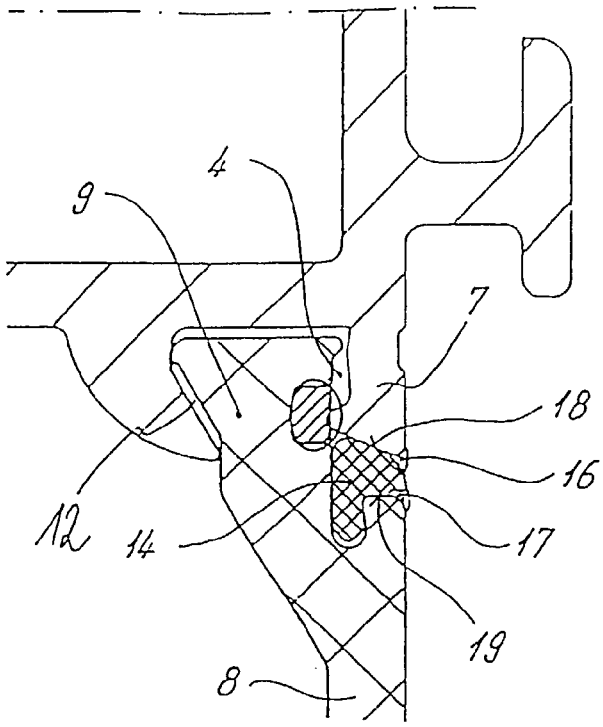
FIGS. 5–12 show a connecting region between a metal profile and an insulating profile in different states of assembly according to another embodiment of the invention.

FIG. 5 shows an enlarged section of another embodiment with details of clamping the base 9 of the insulating profile 8 in one of the metal profiles 1, 2. In this embodiment, the resilient element 14 has softer sealing lips 16 and 17 in the contact region 19 to the insulating profile facing the outside of the projection and in the contact region 18 to the metal profiles as compared to the other material of the resilient elements.

The resilient element 14 is preferably made of plastic and is designed so as to provide elastic or shape resiliency. Accordingly, it has a harder consistency than the sealing elements 16 and 17. The sealing elements 16 and 17 can be mechanically connected to the resilient element 14 as a single piece by co-extrusion, gluing or in other ways. The sealing elements 16 and 17 have a softer consistency which is (preferably exclusively) suitable for sealing purposes.

For example, the resilient element 14 can be made of a rubber-like substance, such as APTK, silicone and the like with a Shore hardness of approximately 60, whereas the sealing elements 16 and 17 made in one piece have a smaller Shore hardness for the special purpose of sealing.

Figure 6:
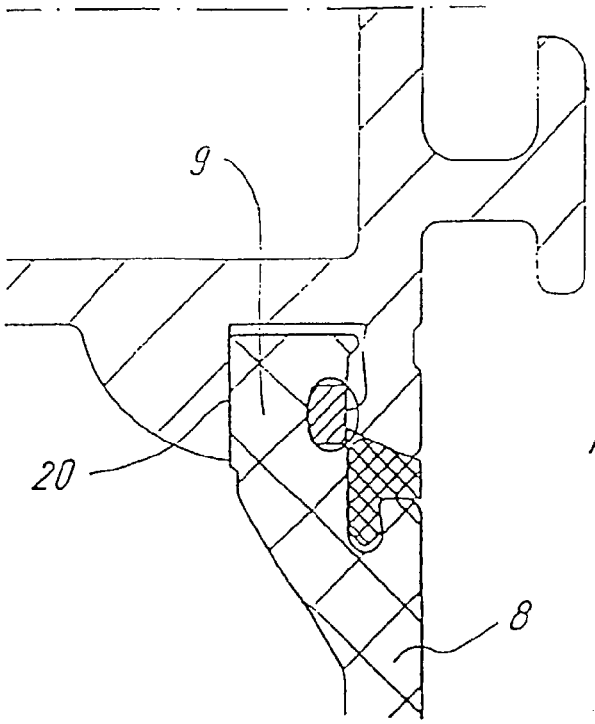

FIG. 6 shows a geometry of the receiving groove 4 which is different from that of FIG. 5. The base section 9 of the insulating profile in this case makes contact with a wall 20, which is oriented parallel to the X-axis and/or the major plane of the composite profile. In this case, there is a non-positive connection between the wall and the base section 9 of the insulating profiles, similar to FIG. 5, however without an undercut which in FIG. 5 is formed as an inclined surface. This modification of the invention also implements the basic principle of the gap S1, S2 between the insulating profiles and the metal profiles. The undercut 7', however, represents a particularly stable advantageous modification of the invention, in particular with respect to the absorption of tensile loads. It is important that the insulating profile or—in this case—the base section 9 are movable in the X-direction during assembly.

Figure 7:
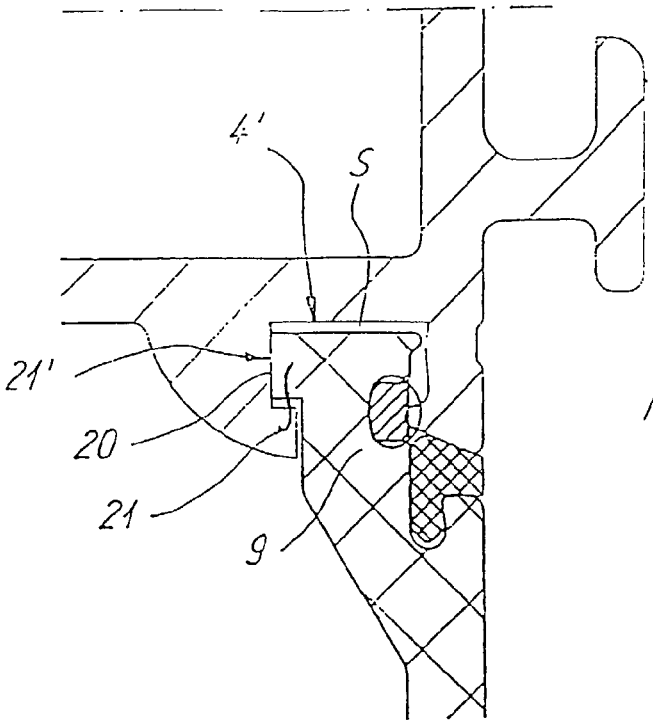

In the embodiment according to FIG. 7, the base section 9 of the insulating profile also makes contact with a wall 20 of the metal profiles. However, the base section 9 has on the free end of the wall 20 a projection 21 which is oriented essentially perpendicular to the X-axis and is intended for reliable engagement of the base section 9 of the insulating rail with a correspondingly formed recess 21' of the metal profiles, whereby the groove bottom 4' of the groove 4 is not contacted for a gap width S greater than zero. A gap 12 is provided for the play of the insulating profile base 9 produced by the tolerances.

Figure 8:
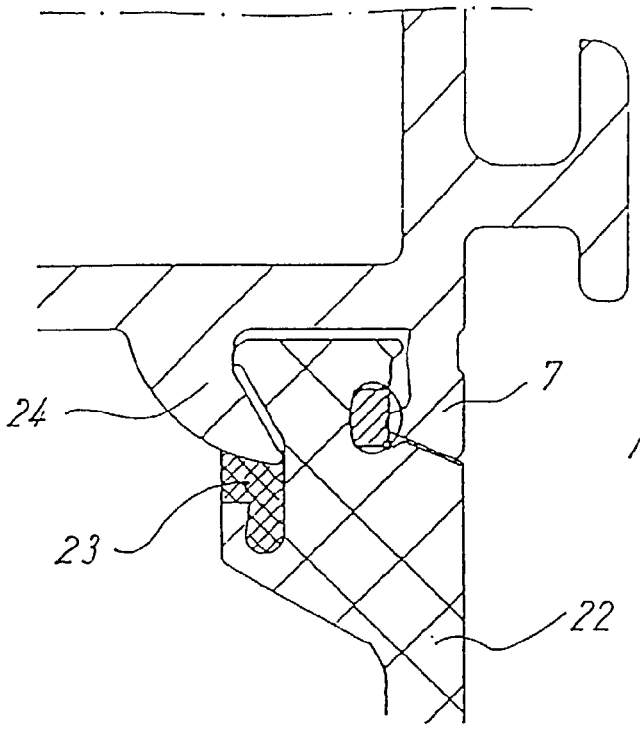

FIG. 8 shows an insulating profile 22 where the resilient element 23 is moved to the opposite side of the inner projection 24, i.e., the resilient element 23 here acts between the front face of the inner insulating rail 22 and the metal profile 1, 2 via the groove projection 24 (here in curved form), which the resilient element 23 contacts.

Figure 9:
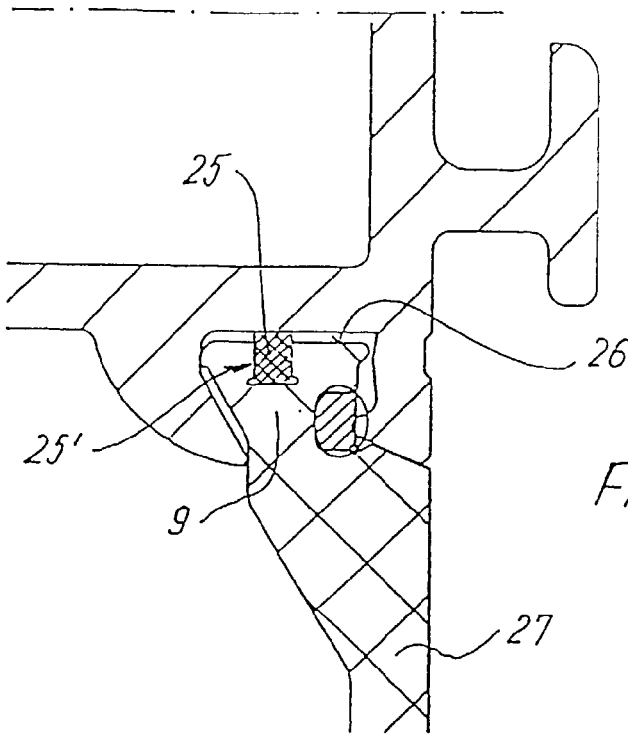

FIG. 9 shows another embodiment of the invention in which the resilient element 20 is inserted into a groove or pocket 25' disposed in the front face 26 of the insulating rail base 9, bridging the gap S. The resilient element 25 can actually fill most or all of the gap and/or can be formed on the insulating profile as a single piece. Alternatively, the groove with the resilient element can also be formed in the metal profile (not shown).

The aforedescribed embodiments of FIG. 3 to FIG. 9 have resilient elements that form a single unit with the insulating profile 3, 8, 22, 27.

The insulating profiles are made of a poorly heat conducting plastic, in particular polyamide, PVC and like, wherein the resilient elements are inserted preferably in grooves or recesses on the insulating profile (or alternatively on the metal profile). The grooves can hold the resilient elements in formfitting or force engagement. The resilient elements can also be easily arranged as a single piece on the insulating rails by co-extrusion, gluing and the like. The form of the resilient elements 14, . . . is not limited to the illustrated embodiments.

The resilient elements can also be formed as a single piece with the insulating rail and (or of the same material—e.g., in form of resilient sections in a one-piece construction with the insulating profile), whereby the consistency of the resilient elements regarding their hardness and compressibility can be different.

Figure 10:
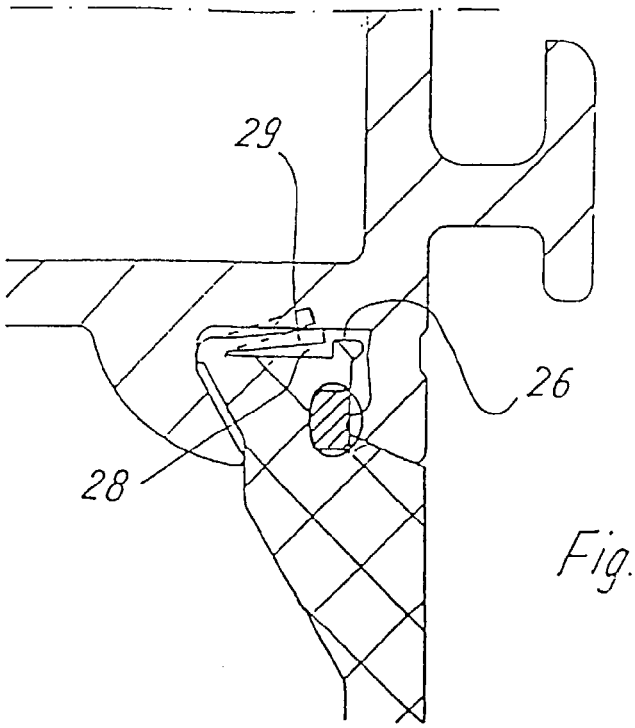

FIG. 10 shows another detail of an engagement of the insulating rail with a corresponding receiving groove on the metal profiles. A recess or pocket 28 is formed in the front face 26, with a strip-shaped flexible tongue 29 disposed on one side of the groove. The pocket/groove 28 is dimensioned so that the flexible tongue 29 is completely received by the pocket 28 when the front face 26 contacts the groove bottom.

Figure 11:
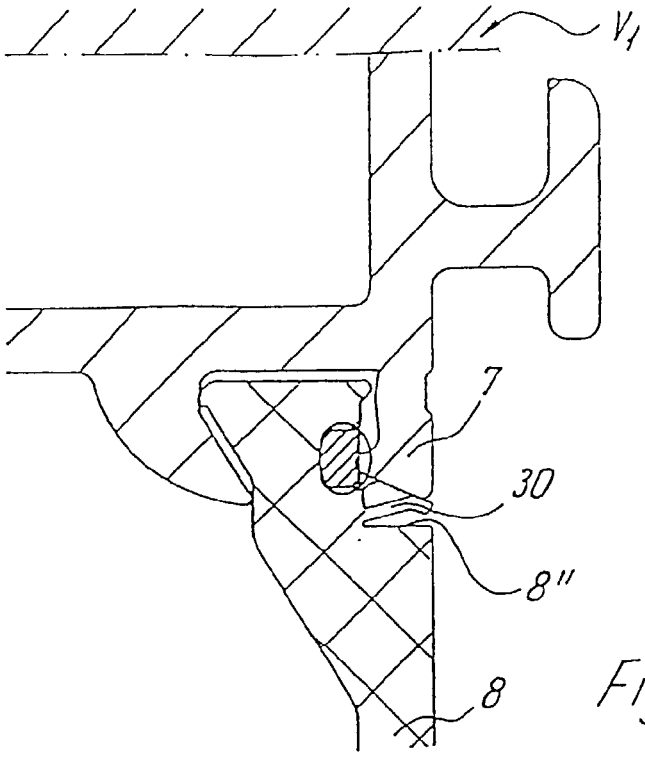

The FIG. 11 shows a flexible tongue 30 disposed on the shoulder 8" instead of a resilient element 14 of the type depicted in FIG. 5. The flexible tongue 30 is supported against the corresponding forming projection 7 of the respective metal profile 1, 2 and exerts the spring action to facilitate contact between the metal profiles and the boundaries V1, V2 of the mounting device.

Figure 12:
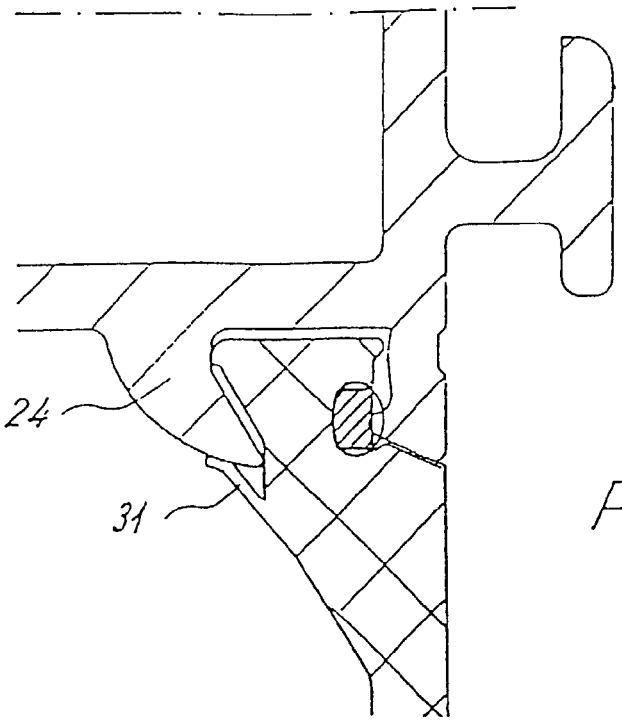

FIG. 12 shows a flexible tongue 31 in place of the resilient element 23 of FIG. 8 which is supported resiliently against the center groove projection 24 of the metal profiles which is curved toward the base section.

The features described above also apply to profiles where the inner projections 7, 7*b* or 24 are formed (e.g., pressed, rolled) instead of the outer profile projections 7 and where the resilient elements 29, 30, 31 are arranged on the metal profiles 1, 2 either as one piece or separately (not shown).

Figure 13:
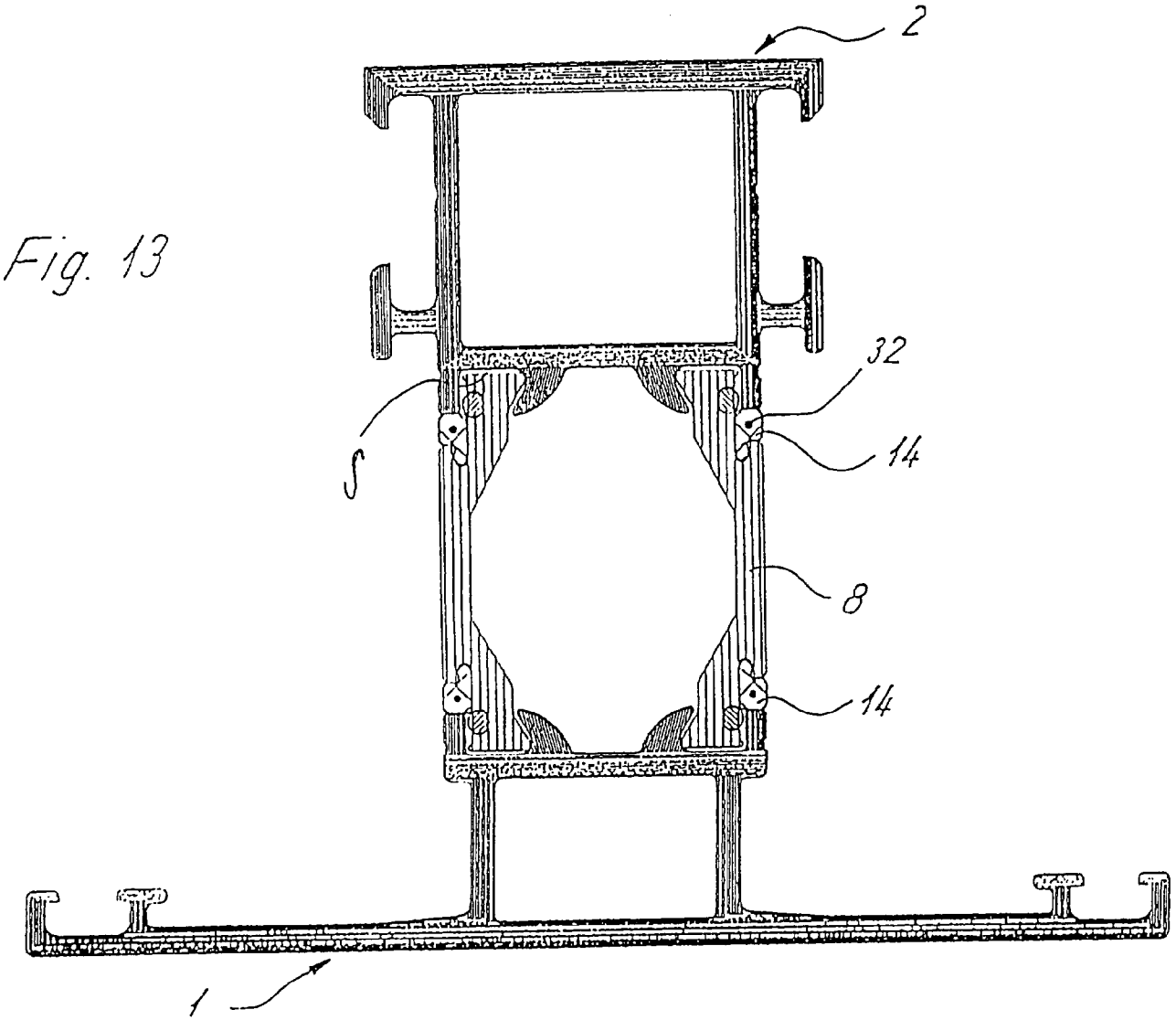
FIG. 13 shows another embodiment of a heat-insulating composite profile.

FIG. 13 shows a heat-insulating composite profile according to the invention with (almost the same outside) geometric dimensions as that shown in FIG. 1, wherein the resilient elements 14 have their operating position between the metal profiles 1, 2 and the insulating profile 8, forming a single unit with the insulating profile. The resilient elements 14 are according to this FIG. provided with a substantially tear-resistant thread 32 which is provided for the types of resilient elements that are made of an elastic material, such as rubber and the like, to prevent stretching and a deterioration of the resilient properties of the resilient element when the resilient element is mounted in the insulating profile.

Figure 14:
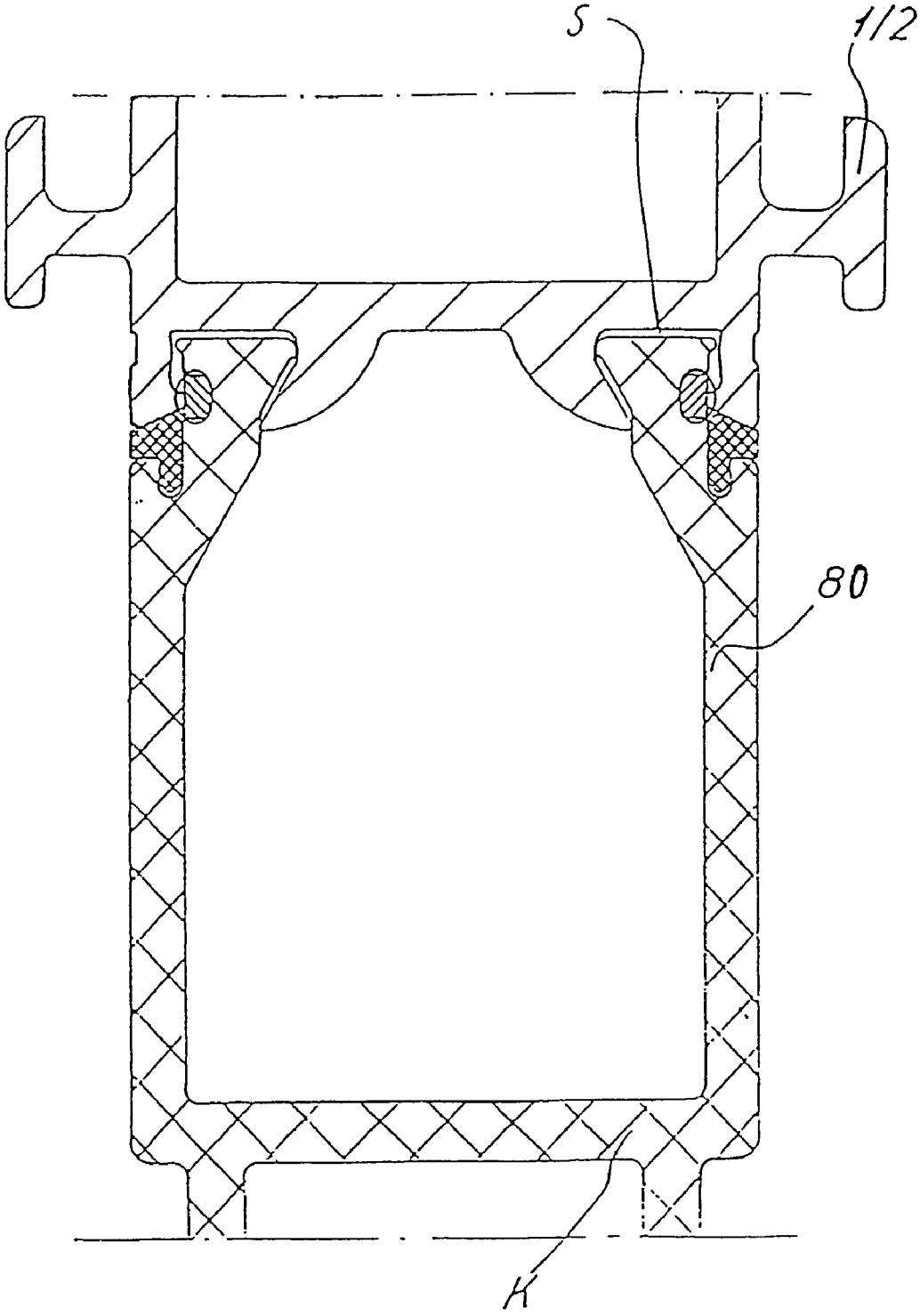
FIG. 14 shows yet another embodiment of a heat-insulating composite profile.

FIG. 14 shows another embodiment of the invention, wherein the at least one insulating profile 80 is formed as a single piece with an outside or inside profile section K made of plastic, so that a second metal profile is no longer required either on the outside or the inside of the composite profile. This composite profile also has a gap S according to the invention located between the only metal profile 1, 2 and the insulating profile 80.

The following should be noted with respect to the tolerances. Typically, so-called theoretical nominal dimensions are taken into account when measuring components, which are indicated in FIG. 1 with the letters A, B, C. Starting with these nominal dimensions, a manufacturing-related clearance space is obtained which can be associated with the nominal dimensions.

The clearance space can have, for example, the nominal dimensions as an upper or lower limit; in this case, the entire clearance space has either negative or positive values.

The nominal dimensions can also represent a value within the clearance space, so that the nominal dimensions can be exceeded in the positive or negative direction.

In the present situation, in particular relating to FIG. 2, this means that either all nominal dimensions have to be modified to ensure—depending on the arrangement of clearance space—that a gap S is always formed on each end of the insulating profile. Alternatively, the nominal dimensions and tolerances according to FIG. 1 and relating to the metal profiles can also be changed, in which case the nominal dimension C of the insulating rail has to be changed so that the gap is between zero and a maximum value when all clearance spaces are compensated.

For these cases, new nominal dimensions C and/or A and B are obtained.

The width of the gap S does not have to be set to a minimum value of zero. A minimum gap width s(min) can be defined, to which in an extreme case the clearance spaces of the three individual components have to be added resulting in a total gap width s(max).

In summary, the invention improves in a simple manner the connection technique for the profiles through a suitable design and a corresponding fabrication method in which the tolerances of the individual components no longer affect (or at least only to a small degree) the total construction depth G of the profile, without significantly changing the outer appearance of the composite profile for a viewer. The nominal dimension of the entire composite profile can be modified by a simple design change in the connecting region between the plastic and metal profiles, without the need to change the nominal dimensions of the individual elements of the profile.

While the invention has been illustrated and described in connection with currently preferred embodiments shown and described in detail, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and their equivalents:

What is claimed is:

1. A composite profile, comprising:

a metal profile having projections to define a receiving groove, an insulating profile having a base section received in the receiving groove at a distance to a groove bottom of the receiving groove to define a gap, and a compressible resilient element disposed between the metal profile and the insulating profile for biasing the metal and insulating profiles in a direction away from one another by a predetermined distance, said resilient element being compressed, when the metal profile is fixed in position relative to the insulating profile by a press fit between the projections of the metal profile and the insulating profile, wherein the resilient element is received in the receiving groove in contact with the groove bottom.

2. The composite profile of claim 1, wherein the insulating profile is made of plastic and formed in single piece construction with a further metal profile.

3. The composite profile of claim 1, wherein the resilient element is formed in single piece construction with the metal profile or the insulating profile.

4. The composite profile of claim 1, wherein the resilient element is formed separate from the at least one metal profile and the at least one insulating profile.

5. The composite profile according to claim 1, wherein the insulating profile includes a recess in an area adjacent to the gap for receiving the resilient element which bridges the gap.

6. The composite profile of claim 5, wherein the recess is so dimensioned and the resilient element is so compressible so that the resilient element is completely received in the recess when an end surface of the insulating profile bears against the groove bottom.

7. The composite profile of claim 1, wherein the resilient element is made of a material selected from the group consisting of rubber, APTK, and silicone.

8. The composite profile of claim 1, wherein the resilient element has a Shore hardness of approximately 60.

9. The composite profile of claim 1, wherein the metal profile is made of a light-weight metal.

10. The composite profile according to claim 1, wherein the projections extend at an angle to the groove bottom of the metal profile.

11. A composite profile, comprising:

a metal profile having projections to define a receiving groove, an insulating profile having a base section received in the receiving groove at a distance to a groove bottom of the receiving groove to define a gap, a compressible resilient element disposed between the metal profile and the insulating profile for biasing the metal and insulating profiles in a direction away from one another by a predetermined distance, said resilient element being compressed, when the metal profile is fixed in position relative to the insulating profile by a press fit between the projections of the metal profile and the insulating profile, and a further said metal profile for receiving an opposite base section of the insulating profile at formation of a gap, and a further said compressible resilient element between the further metal profile and the insulating profile, wherein the insulating profile includes a recess in an area adjacent to the gap for receiving the resilient element which bridges the gap.

12. The composite profile of claim 11, wherein the gaps formed between the metal profiles and the insulating profile have a substantially identical dimension.

13. The composite profile of claim 11, wherein each of the gaps is dimensioned to be equal to at least ½ of a maximum negative total tolerance with reference to a direction normal to the groove bottom.

14. The composite profile of claim 11, wherein a combined gap width of the gaps is equal to a sum of individual dimensional tolerances of the sequentially arranged two metal profiles and the insulating profile.

15. The composite profile of claim 14, wherein the combined gap width of the corresponding gaps is selected to be greater than the sum of individual dimensional tolerances of the sequentially arranged two metal profiles and the insulating profile.

16. A composite profile, comprising:

a metal profile having projections to define a receiving groove, an insulating profile having a base section received in the receiving groove at a distance to a groove bottom of the receiving groove to define a gap, and a compressible resilient element formed as a flexible tongue and disposed between the metal profile and the insulating profile for biasing the metal and insulating profiles in a direction away from one another by a predetermined distance, said resilient element being compressed, when the metal profile is fixed in position relative to the insulating profile by a press fit between the projections of the metal profile and the insulating profile, wherein the flexible tongue is constructed to rest against one of the projections of the metal profile.

17. The composite profile of claim 16, wherein the flexible tongue is constructed to rest against the groove bottom of the metal profile.

18. A composite profile, comprising:

a metal profile having projections to define a receiving groove, an insulating profile having a base section received in the receiving groove at a distance to a groove bottom of the receiving groove to define a gap, and a compressible resilient element disposed between the metal profile and the insulating profile for biasing the metal and insulating profiles in a direction away from one another by a predetermined distance, said resilient element being compressed, when the metal profile is fixed in position relative to the insulating profile by a press fit between the projections of the metal profile and the insulating profile, wherein at least one of the projections includes an undercut on a projection side facing the receiving groove, with the base section of the insulating profile engaging with the undercut.

19. The composite profile of claim 18, wherein an intermediate gap is formed in the region where the base section of the at least one insulating base engages with the undercut.

20. A composite profile, comprising:

a metal profile having projections to define a receiving groove, an insulating profile having a base section received in the receiving groove at a distance to a groove bottom of the receiving groove to define a gap, and a compressible resilient element disposed between the metal profile and the insulating profile for biasing the metal and insulating profiles in a direction away from one another by a predetermined distance, said resilient element being compressed, when the metal profile is fixed in position relative to the insulating profile by a press fit between the projections of the metal profile and the insulating profile, wherein the base section of the insulating profile includes a projection oriented substantially parallel to the groove bottom and engaging a recess disposed in one of the projections of the metal profile, with the projection being moveable in the recess before the metal profile is fixed in position.

21. A composite profile, comprising:

a metal profile having projections to define a receiving groove, an insulating profile having a base section received in the receiving groove at a distance to a groove bottom of the receiving groove to define a gap, and a compressible resilient element disposed between the metal profile and the insulating profile for biasing the metal and insulating profiles in a direction away from one another by a predetermined distance, said resilient element being compressed, when the metal profile is fixed in position relative to the insulating profile by a press fit between the projections of the metal profile and the insulating profile, wherein the insulating profile includes a shoulder oriented parallel to the receiving groove, with the resilient element disposed between the shoulder and one of the projections.

22. A composite profile, comprising:

a metal profile having projections to define a receiving groove, an insulating profile having a base section received in the receiving groove at a distance to a groove bottom of the receiving groove to define a gap, a compressible resilient element disposed between the metal profile and the insulating profile for biasing the metal and insulating profiles in a direction away from one another by a predetermined distance, said resilient element being compressed, when the metal profile is fixed in position relative to the insulating profile by a press fit between the projections of the metal profile and the insulating profile, and a sealing element disposed between the metal profile and the insulating profile.

23. The composite profile of claim 22, wherein the sealing element is connected with the insulating profile or the metal profile.

24. The composite profile of claim 22, wherein the sealing element is formed separately from the insulating profile or the metal profile.

25. A composite profile, comprising:

a metal profile having projections to define a receiving groove, an insulating profile having a base section received in the receiving groove at a distance to a groove bottom of the receiving groove to define a gap, and a compressible resilient element disposed between the metal profile and the insulating profile for biasing the metal and insulating profiles in a direction away from one another by a predetermined distance, said resilient element being compressed, when the metal profile is fixed in position relative to the insulating profile by a press fit between the projections of the metal profile and the insulating profile, wherein the resilient element includes sealing lips contacting the insulating profile and the metal profile, with the sealing lips made of a material that is softer than a material of the resilient element.

26. A composite profile, comprising:

a metal profile having projections to define a receiving groove, an insulating profile having a base section received in the receiving groove at a distance to a groove bottom of the receiving groove to define a gap, and a compressible resilient element disposed between the metal profile and the insulating profile for biasing the metal and insulating profiles in a direction away from one another by a predetermined distance, said resilient element being compressed, when the metal profile is fixed in position relative to the insulating profile by a press fit between the projections of the metal profile and the insulating profile, wherein the resilient element includes a tear-resistant thread.

27. A method for producing a composite profile, comprising:

providing a metal profile having a receiving groove with a groove bottom and projections oriented at an angle to the groove bottom, and an insulating profile;

inserting the insulating profile into the receiving groove of the metal profile;

placing a compressible resilient element between the metal profile and the insulating profile for biasing the metal and insulating profiles in a direction away from one another;

aligning the metal profile and the insulating profile relative to each other in a mounting device so that opposing outer sides of the metal profile and the insulating profile are spaced apart from each other by a nominal distance, and urging the metal profile against guide elements of the mounting device so as to compress the resilient element and to force the projections against the insulating profile to thereby fix the position of the metal profile relative to the insulating profile.

28. The method of claim 27, and further comprising the step of forming a gap between the groove bottom and the insulating profile to provide a spacing between the insulating profile and the groove bottom.

29. The method of claim 27, wherein the resilient element exerts a force on the metal profile causing the metal profile to contact the mounting device.

30. A composite profile, comprising:

a metal profile having projections to define a receiving groove, an insulating profile having a base section received in the receiving groove at a distance to a groove bottom of the receiving groove to define a gap, and a compressible resilient element disposed between the metal profile and the insulating profile for biasing the metal and insulating profiles in a direction away from one another by a predetermined distance, said resilient element being compressed, when the metal profile is fixed in position relative to the insulating profile by a press fit between the projections of the metal profile and the insulating profile, wherein the resilient element is received between one of the projections and an opposite contact surface of the insulating profile.

31. The composite profile of claim 30, wherein the base section of the insulating profile engages a wall of the metal profile in a non-positive manner.

32. A composite profile, comprising:

a metal profile having projections to define a receiving groove, an insulating profile having a base section received in the receiving groove at a distance to a groove bottom of the receiving groove to define a gap, a compressible resilient element disposed between the metal profile and the insulating profile for biasing the metal and insulating profiles in a direction away from one another by a predetermined distance, said resilient element being compressed, when the metal profile is fixed in position relative to the insulating profile by a press fit between the projections of the metal profile and the insulating profile, and a wire arranged between the insulating profile and the metal profile.

33. The composite profile of claim 32, wherein the wire is disposed in a recess formed in the base section of the insulating profile and formfittingly engages one of the projections.

* * * * *